US007798110B2

(12) United States Patent
Sedda et al.

(10) Patent No.: US 7,798,110 B2
(45) Date of Patent: Sep. 21, 2010

(54) ELECTROMAGNET-EQUIPPED CONTROL DEVICE FOR AN INTERNAL COMBUSTION ENGINE VALVE

(75) Inventors: Emmanuel Sedda, Soisy Sous Montmorency (FR); Christophe Fageon, Montrouge (FR); Jean-Paul Yonnet, Meylan (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 731 days.

(21) Appl. No.: 11/578,317

(22) PCT Filed: Jan. 27, 2005

(86) PCT No.: PCT/FR2005/050051

§ 371 (c)(1),
(2), (4) Date: Jul. 16, 2007

(87) PCT Pub. No.: WO2005/075796

PCT Pub. Date: Aug. 18, 2005

(65) Prior Publication Data

US 2008/0035093 A1 Feb. 14, 2008

(30) Foreign Application Priority Data

Jan. 27, 2004 (FR) ..... 04 50152

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.15, 129.16
See application file for complete search history.

(56) References Cited

U.S. PATENT DOCUMENTS

| | | | | |
|---|---|---|---|---|
| 3,422,407 | A | 1/1969 | Wenny | |
| 3,743,898 | A | 7/1973 | Sturman | |
| 4,114,648 | A | 9/1978 | Nakajima | |
| 4,533,890 | A | 8/1985 | Patal | |
| 5,074,259 | A * | 12/1991 | Pusic | 123/90.11 |
| 5,339,777 | A | 8/1994 | Cannon | |
| 5,488,340 | A | 1/1996 | Maley | |

FOREIGN PATENT DOCUMENTS

| | | |
|---|---|---|
| EP | 0 816 671 | 1/1998 |
| EP | 1 134 363 | 9/2001 |
| EP | 1 174 595 | 1/2002 |
| EP | 1 281 854 | 2/2003 |

* cited by examiner

*Primary Examiner*—Ching Chang
(74) *Attorney, Agent, or Firm*—Nicolas E. Seckel

(57) ABSTRACT

The invention pertains to a device for controlling the opening and closing of an internal combustion engine valve. This device is characterized in that the magnetic circuit of the electromagnet and/or the plate contains a magnetic material having a remnant magnetization (Fp) when the valve is in position, the remnant magnetization (Fp) being reversible so as to be cancelled when the valve changes position and having a coercive field strength in the range of 10 Oe to 600 Oe.

10 Claims, 2 Drawing Sheets

ELECTROMAGNET-EQUIPPED CONTROL DEVICE FOR AN INTERNAL COMBUSTION ENGINE VALVE

FIELD OF THE INVENTION

The present invention pertains to a valve control device for an internal combustion engine, as well as an engine equipped with such a device.

BACKGROUND

The valves are essential elements of internal combustion engines. They permit the operation of the latter by alternating between two positions:

A first, so-called "open" position makes possible exchanges between the interior and the exterior of a cylinder using this valve, for example, to inject a fuel into this cylinder.

A second, so-called "closed" position prevents any exchange between the interior and the exterior of this cylinder, for example, to make possible the compression of injected fuel.

In a classical engine, the valves are actuated by means of relatively complicated mechanical links with the rest of the engine. Engines with electrically controlled valves have recently been developed, and this control makes it possible to choose the opening and closing times at will.

Such a device comprises springs and at least one or two electromagnets, the latter receiving control signals for positioning the valve in the open or closed position.

A known device of this type is shown in FIG. 1. It comprises a coil spring 12 surrounding a rod 14 that is integral with a valve 10 and resting, on the one hand, against a stop 16 that is integral with this rod 14 and, on the other hand, against a stop 18 surrounding an opening 20 of the body of the corresponding cylinder 21.

Another rod 22 carrying a plate 26 made of magnetic material cooperates with the rod 14 (or valve stem). Between the rods 22 and 14 is provided a clearance 24, enabling the rod 22 to slide, even though the rod 14 remains immobile when the rod 22 is in the final position towards the top of FIG. 1.

The plate 26 is installed between two electromagnets 28 and 30 passed through by the rod 22. These two electromagnets 28 and 30 contain a coil each, which is conventionally represented in the cross section of FIG. 1 by two crosses, and a magnetic circuit, 29 and 31, respectively, made of magnetic material. The end 32 of the rod 22, which is opposed to the link 24, cooperates with the first end of another spring 34.

The second end of this spring 34 is fixed to a support 36 that is integral with a chassis 37. The springs 34 and 12 keep the plate 26 equidistant from the two electromagnets 28 and 30 when the latter are not generating a magnetic field. This position can be adjusted by varying the position of the support 36 in relation to the chassis 37.

When the electromagnet 28 is activated, it attracts the plate 26 and the latter comes into contact with a part of the magnetic circuit of this electromagnet 28. This movement leads to a sliding of the rod 22 and of the rod 14—along an axis 27 merged with the axis of these rods—such that the head 38 of the valve 10 is brought to rest on its seat. The valve 10 is then closed.

When the electromagnet 30 is activated, the latter attracts the plate 26, which comes into contact with a part of the magnetic circuit of this second electromagnet, leading the rod 22 and the rod 14 along the axis 27, the head 38 consequently being moved away from its seat. The valve 10 is then in the open position.

The springs 12 and 34 are associated with the movement of the rods 14 and 22, being compressed or slackened according to the movements of the latter, a resonant electromechanical system thus being formed.

In some embodiments, for reasons of saving energy during the maintenance of the valve in the open or closed position, the magnetic circuits 29 and 31 of the electromagnets are of the so-called polarized type, i.e., they comprise a permanent magnet. This permits a magnetic blocking of the plate 26 in the open or closed position, respectively, with zero or low current in the electromagnet 30 or 28, respectively. However, it is consequently necessary to provide a force during the transitions from one position to another because the magnetic force generated by the permanent magnet must be overcome. Such a force is costly in terms of energy.

SUMMARY OF THE INVENTION

The present invention is a result of the observation that a control device of this type is not optimized in terms of energy.

The present invention eliminates these drawbacks. It pertains to an electromechanical device for controlling the valve of an internal combustion engine, characterized in that the magnetic circuit of the electromagnet and/or the plate contain a magnetic material having a remnant magnetization when the valve is in the open or closed position, the remnant magnetization being reversible so as to be cancelled when the valve changes position and having a coercive field strength in the range of 10 Oe to 600 Oe.

Materials having a remnant and reversible magnetization are also commonly called semi-hard or hysteresis materials. The materials used in the present invention have a high remnant flux density as well as an intermediate coercive field strength in comparison to soft materials and to hard materials. In fact, the hysteresis of a magnetic material is defined by two magnetic variables: The coercive field strength and the flux density. In the soft materials, the hysteresis loop is very narrow, which does not make it possible to observe a remnant magnetization. Their coercive field strength is often lower than 1 Oe (80 A/m). In permanent magnets the hysteresis loop is as wide as possible. It is agreed that the domain of permanent magnets begins with the materials which have a coercive field strength of at least 600 Oe (5,000 A/m). One of the drawbacks of these materials is that it is difficult to subject them to demagnetization. The other magnetic variable, the flux density B, characterizes the capacity to have an induced magnetization. It is well understood that it is advantageously as high as possible in the present invention.

A material having a high flux density value as well as an intermediate coercive field strength may thus be magnetized in a remnant and reversible manner. Depending on the moment within an opening and closing cycle of the valve, the magnetization of the plate and/or the magnetic circuit of the electromagnet may thus be modified. This makes it possible to have a plate and/or a magnetic circuit magnetized during the maintenance of the valve in position. Therefore, this maintenance is possible with a zero or low current in the electromagnet. A coercive field strength value of 10 Oe makes it possible to obtain a maintenance in the correct position in the valve applications. Such a maintenance is not ensured by a simple material having a remnant magnetization of the type of the Hard Steels (carbon steel, for example) which are sometimes used. Such a residual magnetism is of the type which is observed with a piece made of steel which is momentarily magnetized and which manages to attract nails, for example. Such a coercive field strength value also makes it possible to demagnetize the plate and/or the magnetic circuit of the electromagnet just before the transition from one position to another so as not to have to provide significant force during the transition. The magnetization modifications do not require a large amount of energy, the consumption of electric energy of the device is reduced compared to a prior-art device.

According to a preferred embodiment, the material having a remnant and reversible magnetization has a coercive field strength in the range of 50 Oe to 500 Oe.

Such a selective range of the coercive field strength, which is particularly suitable for valve applications, makes it possible to ensure a good maintenance and to minimize the energy needed for demagnetizing the material.

This material is advantageously selected from among the Iron-Cobalt-Vanadium alloys or from the Alnico (Aluminum-Nickel-Cobalt) alloys with low coercive field strength.

According to an advantageous embodiment, the material having a remnant and reversible magnetization is in the laminated form.

The laminated form is obtained when the material is produced in a strip. This is the case for the FeCoVa alloys, for example. The laminated form reduces the losses due to induced currents.

In one embodiment, the positioning of the valve in a second position (closed or open) is obtained by the action of a second electromagnet acting on the plate, the magnetic circuit of the second electromagnet and/or the plate containing a material having a remnant and reversible magnetization.

Other features and advantages of the present invention shall become apparent from the description provided below, which is given in a descriptive and nonlimiting manner by making reference to the attached drawings, in which:

In the example proposed in FIGS. 2*a* through 2*e*, the plate is the element of the device containing a material with remnant and reversible magnetization.

DETAILED DESCRIPTION

The control device according to the present invention contains an electromagnet 28 and a plate 26, which is integral with a valve, not shown in FIGS. 2*a* through 2*e*. The electromagnet 28 comprises a coil shown by two crosses in the cross sections shown in FIGS. 2*a* through 2*e* and a magnetic circuit 29 made of magnetic material.

Figure 1:
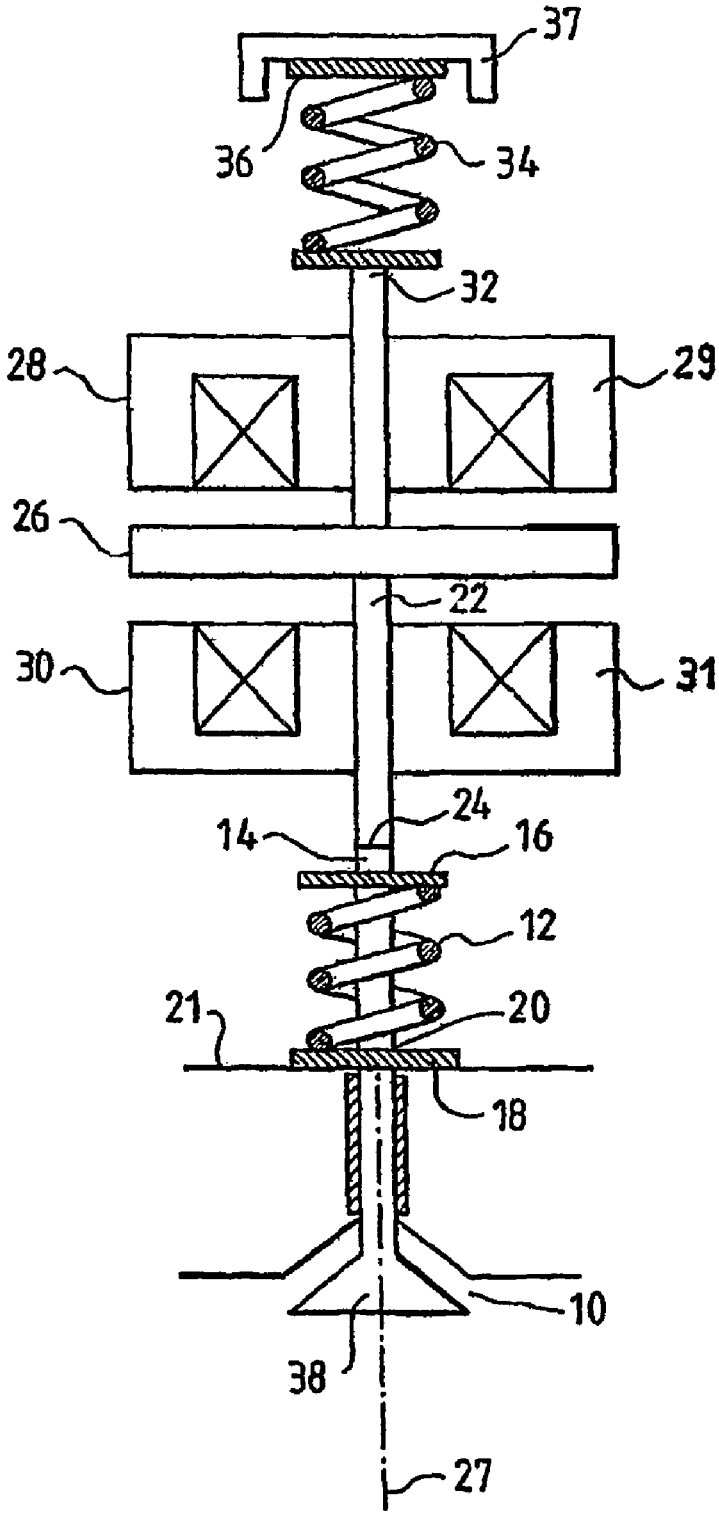
FIG. 1, already described, shows a prior-art valve control device.
Figure 2A:
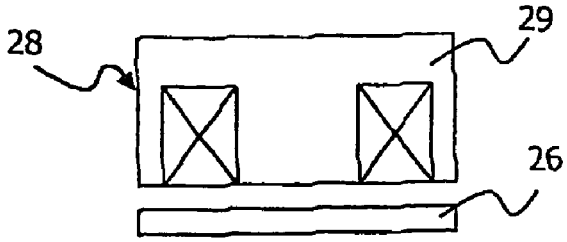
FIGS. 2*a*, 2*b*, 2*c*, 2*d*, and 2*e* are diagrams illustrating the operation of a control device according to the present invention.

Without premagnetization of the plate 26 and without current in the coil, as shown in FIG. 2*a*, no force is created between the plate 26 and the electromagnet 28.

Figure 2B:
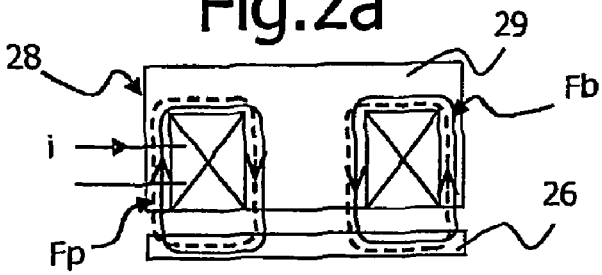
Figure 2C:
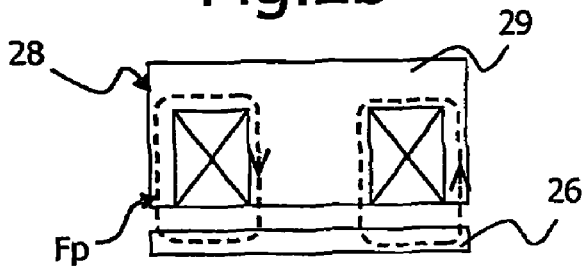
Figure 2D:
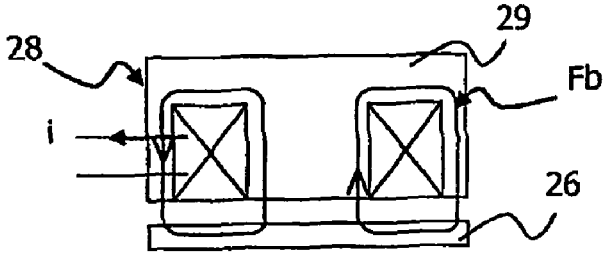
Figure 2E:
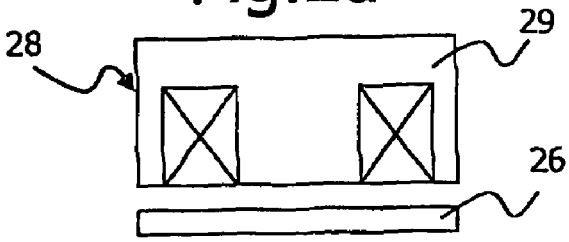

With the establishment of the current i in the coil, as shown in FIG. 2*b*, a flux Fb is created which magnetizes the plate 26 made of a semi-hard material. In its turn and following the direction of the current in the coil, the plate then creates a so-called remnant flux Fp.

Upon interruption of the current in the coil, the remnant flux Fp created by the remnant magnetization of the plate 26 in the magnetic circuit 29 of the electromagnet 28 makes it possible to preserve a considerable flux density in the magnetic circuit 29 of the electromagnet 28 and therefore to generate an electromagnetic force between the plate 26 and the electromagnet 28. This force does not practically depend on the intensity of the current previously applied to the coil. The plate 26 can then be maintained in position with a zero or low current in the same manner as with a plate having a permanent magnetization.

On application of a current of reverse direction in relation to the current previously applied in the coil, the plate 26 is demagnetized. The remnant flux Fp then disappears. It should be noted that if the current applied is too significant, according to the hysteresis phenomenon characteristic of these materials, the plate 26 will be demagnetized again but in a direction that is opposite to the previous ones. In the intended application, this situation is to be avoided because it would then again produce an attraction between the plate 26 and the electromagnet 28. Knowing the variables characteristic of the hysteresis loop of the material makes it possible to easily avoid failure.

Upon the interruption of the current having a direction opposite to the coil, the control device is again in the situation shown in FIG. 2*a*, i.e., without premagnetization or with a reduced premagnetization and thus, without force exerted on the plate 26.

Therefore, the application of a current having a direction opposite to the coil makes it possible to release the plate 26, which becomes easy to mobilize for performing the transition from one position to another. A small force is then needed to perform this transition.

In summary, the plate is magnetized by the flux of the coil each time the plate is attracted by the electromagnet, for example, when starting or during a transition. During the maintenance in the open or closed position, the remnant magnetization of the plate makes it possible to preserve a considerable flux density in the magnetic circuit. This makes it possible to obtain a maintenance force, which may be sufficient to obtain the maintenance with zero or low current in the coil. To release the plate, for example, during a transition, a demagnetization current is applied to demagnetize the plate.

The advantages of the present invention are, in particular, to obtain a blocking in the open or closed position with zero or low current and, at the same time, to make possible transitions that are low cost in terms of energy because the magnetization can be cancelled at the time of the transition.

The cycle of applying current to the coil, which is defined by the intensity and the direction of the current and the durations of application, depends on the cycle desired for the opening and closing of the valve.

For example, when, according to an embodiment shown above, the positioning of the valve in a second position is obtained by the action of a second electromagnet acting on the plate, the current intended to pass through this second electromagnet is synchronized with the negative current passing through the first electromagnet for demagnetizing the plate. In this case, the transition is not very costly in terms of energy because the plate is released by the first electromagnet at the moment when it is called to be moved towards the second electromagnet.

An additional advantage of the present invention lies in the fact that the semi-hard materials have a greater apparent permeability than that of magnets. Therefore, this generates a better effectiveness of the coil. In addition, a device according to the present invention does not have the risk of irreversible demagnetization of the plate, and such a defect is all the more detrimental in the applications requiring a high reliability such as an engine.

In the description of FIGS. 2*a* through 2*e*, the present invention was presented with a plate made of semi-hard material. According to a variant of the present invention, the plate contains a soft magnetic material and the magnetic circuit of the electromagnet contains a magnetic material with remnant and reversible magnetization. It is also possible to contemplate that the plate and the magnetic circuit of the electromagnet both contain a semi-hard magnetic material.

Even though the present invention has been described in accordance with the embodiments presented, a person skilled in the art will recognize that there are alternatives to the embodiments presented, and that these variants continue to be within the spirit and scope of the present invention.

For example, the positioning of the valve in a second position can also be performed according to the action of prior-art, in particular mechanical, means. In this case, only one position, open or closed, is ensured according to the present invention. The other position can, for example, use a spring.

What is claimed is:

1. A device for controlling the opening and closing of an internal combustion engine valve, comprising:

an electromagnet containing a coil and a magnetic circuit;

a plate, coupled to the valve to control the positioning of the valve;

wherein, at least one magnetic element selected from (i) the magnetic circuit of the electromagnet and (ii) the plate contains a magnetic material having a state of remnant magnetization when the valve is in the open or closed position, the remnant magnetization being cancelable and reversible so as to be cancelled when the valve changes position and having a coercive field strength in the range of 10 Oe to 600 Oe, wherein the coil is supplied sequentially with (i) a magnetization current such that the flux of the coil magnetizes the magnetic element to the state of remnant magnetization, and (ii) a demagnetization current such that the flux of the coil cancels the remnant magnetization of the magnetic element.

2. The device in accordance with claim 1, characterized in that the material having remnant and reversible magnetization has a coercive field strength in the range of 50 Oe to 500 Oe.

3. The device in accordance with claim 1, characterized in that the material having a remnant and reversible magnetization is selected from among the Iron-Cobalt-Vanadium alloys.

4. The device in accordance with claim 1, characterized in that the material having a remnant and reversible magnetization is selected from among the Aluminum-Nickel-Cobalt alloys with low coercive field strength.

5. The device in accordance with claim 1, characterized in that the material having a remnant and reversible magnetization is in laminated form.

6. The device in accordance with claim 1, wherein the electromagnet is a first electromagnet, the coil is a first coil, the magnetic circuit is a first magnetic circuit, the magnetization current is a first magnetization current, and the demagnetization current is a first demagnetization current, wherein the positioning of the valve in a second position (closed or open) is obtained by the action of a second electromagnet acting on the plate, the second electromagnet containing a second coil and a second magnetic circuit, wherein at least one second element selected from (i) the magnetic circuit of the second electromagnet and (ii) the plate also contains a magnetic material having a remnant magnetization when the valve is in the open or closed position, the remnant magnetization being cancelable and reversible so as to be cancelled when the valve changes position and having a coercive field strength in the range of 10 Oe to 600 Oe, wherein the second coil is supplied sequentially with (i) a second magnetization current such that the flux of the second coil magnetizes the second magnetic element to the state of remnant magnetization, and (ii) a second demagnetization current such that the flux of the second coil cancels the remnant magnetization of the second magnetic element.

7. The device in accordance with claim 6, wherein the first and second magnetic elements are constituted by the plate, the second magnetization current reverses the magnetization of the plate produced by the first magnetization, and the first magnetization current reverses the magnetization of the plate produced by the second magnetization current.

8. The device according to claim 6, wherein the first demagnetization current is applied to release the plate in synchronization with the second magnetization current, and the second demagnetization current is applied to release the plate in synchronization with the first magnetization current.

9. Internal combustion engine comprising a control device in accordance with claim 1.

10. The device in accordance with claim 1, wherein the coil is supplied with the demagnetization current at a time of releasing the plate from at least one of open and closed positions.

* * * * *